US005083356A

United States Patent [19]

Gonzalez et al.

[11] Patent Number: 5,083,356

[45] Date of Patent: Jan. 28, 1992

[54] COLLAR LOAD SUPPORT TUBING RUNNING PROCEDURE

[75] Inventors: Manuel E. Gonzalez, Humble; Joe M. Escobar, Viboras Encino; Doyle F. Boutwell, Jr., Houston, all of Tex.; Mark Sibille; Charles M. Webre, both of Lafayette, La.

[73] Assignee: Exxon Production Research Company, Houston, Tex.

[21] Appl. No.: 592,586

[22] Filed: Oct. 4, 1990

[51] Int. Cl.[5] ..... B23P 19/04; B23P 11/00

[52] U.S. Cl. ..... 29/429; 29/433

[58] Field of Search ..... 29/428, 433, 429

[56] References Cited

U.S. PATENT DOCUMENTS

| | | | |
|---|---|---|---|
| Re. 32,642 | 4/1988 | Boudreaux et al. . | |
| 2,976,930 | 3/1961 | Marquis . | |
| 3,766,632 | 10/1973 | Goeke | 29/428 |
| 3,831,259 | 8/1974 | Goulas | 29/428 |
| 3,838,493 | 10/1974 | Zahuranec et al. | 29/433 |
| 3,913,687 | 10/1975 | Gyongyosi et al. . | |
| 4,060,286 | 11/1977 | Boice | 29/433 X |
| 4,111,388 | 9/1978 | Presley . | |
| 4,603,464 | 8/1986 | Smith, Jr. et al. | 29/428 |
| 4,915,177 | 4/1990 | Claycomb . | |
| 4,989,909 | 2/1991 | Boulighy, Jr. et al. | 294/119.3 |

*Primary Examiner*—Timothy V. Eley
*Assistant Examiner*—C. Richard Martin
*Attorney, Agent, or Firm*—Pravel, Gambrell, Hewitt, Kimball & Krieger

[57] ABSTRACT

A method for non-abrasively running tubing comprising suspending the tubing from the face of the uppermost collar of the tubing by resting the face upon a support shoulder, making up a new tubular with collar into a tubular unit, attaching a non-abrasive lift unit to a tubular unit, stabbing the new tubular into the upper collar, non-abrasively making the connection tight, and lifting the lift unit to raise the string, the method being appropriately reversed for pulling the string.

16 Claims, 6 Drawing Sheets

FIG.1
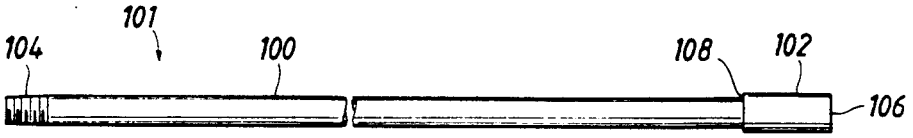
FIG.1A
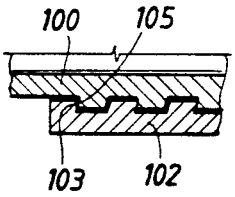
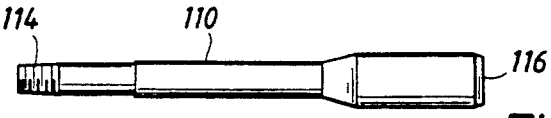
FIG.2
FIG.3
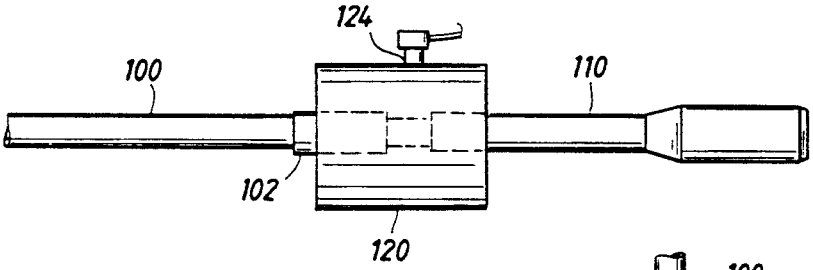
FIG.4
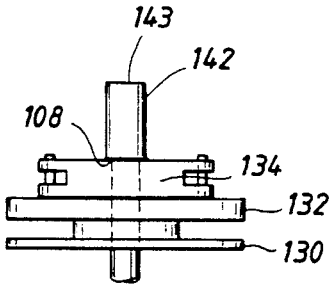
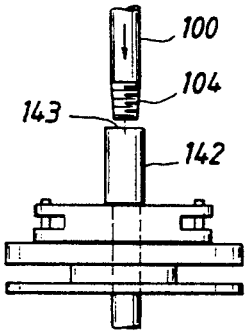
FIG.5
FIG.6
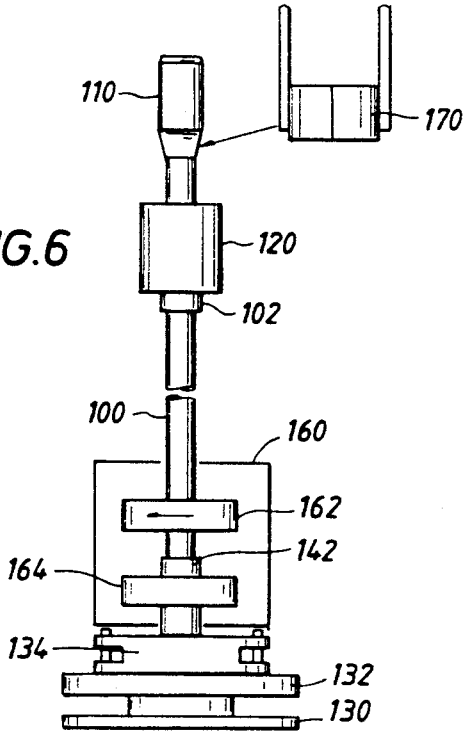
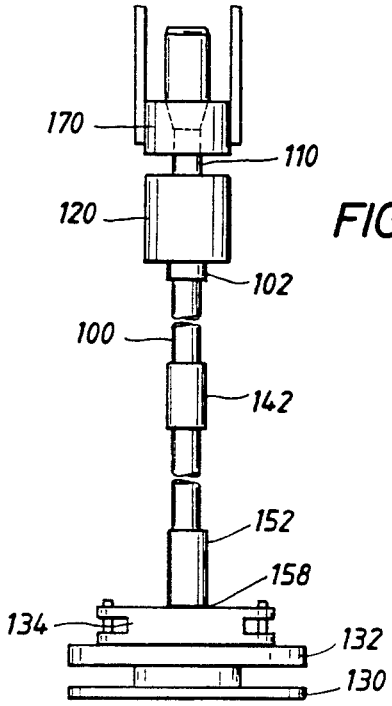
FIG.7

FIG.13
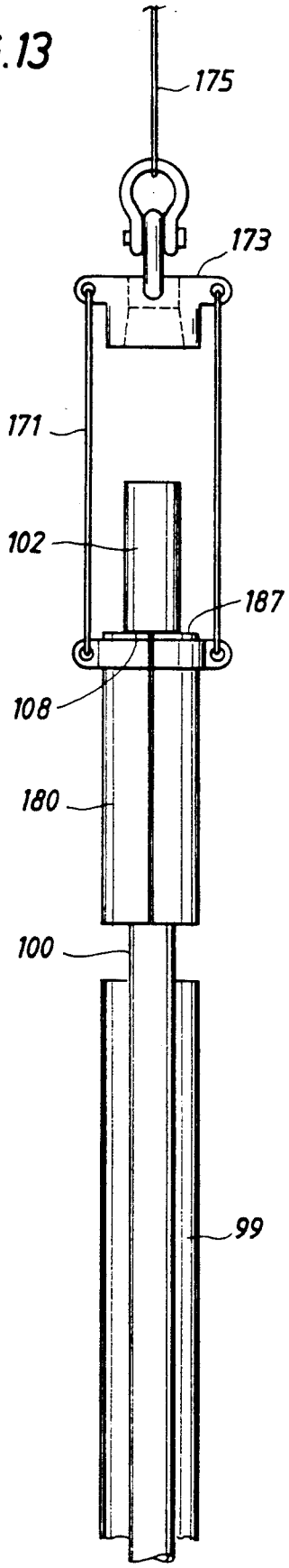
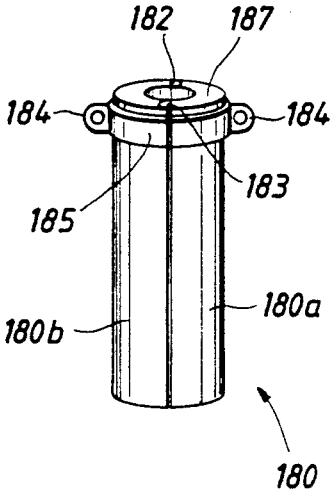
FIG.15
FIG.14
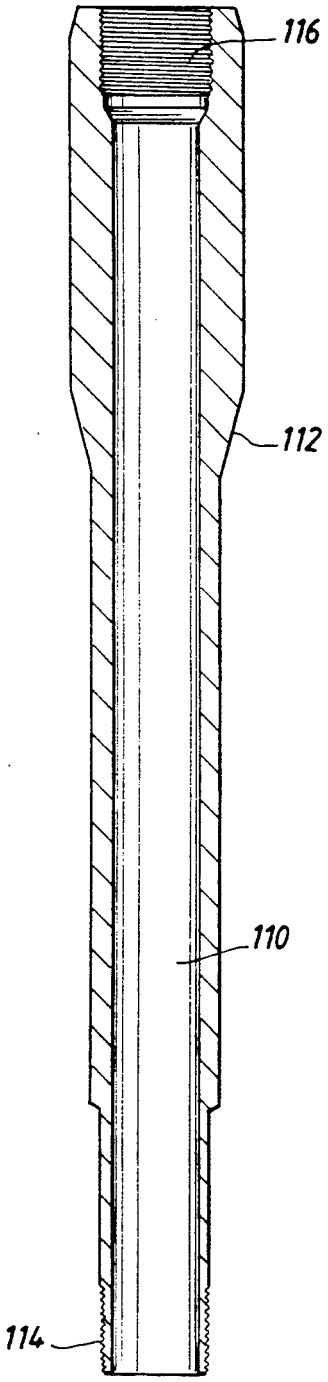

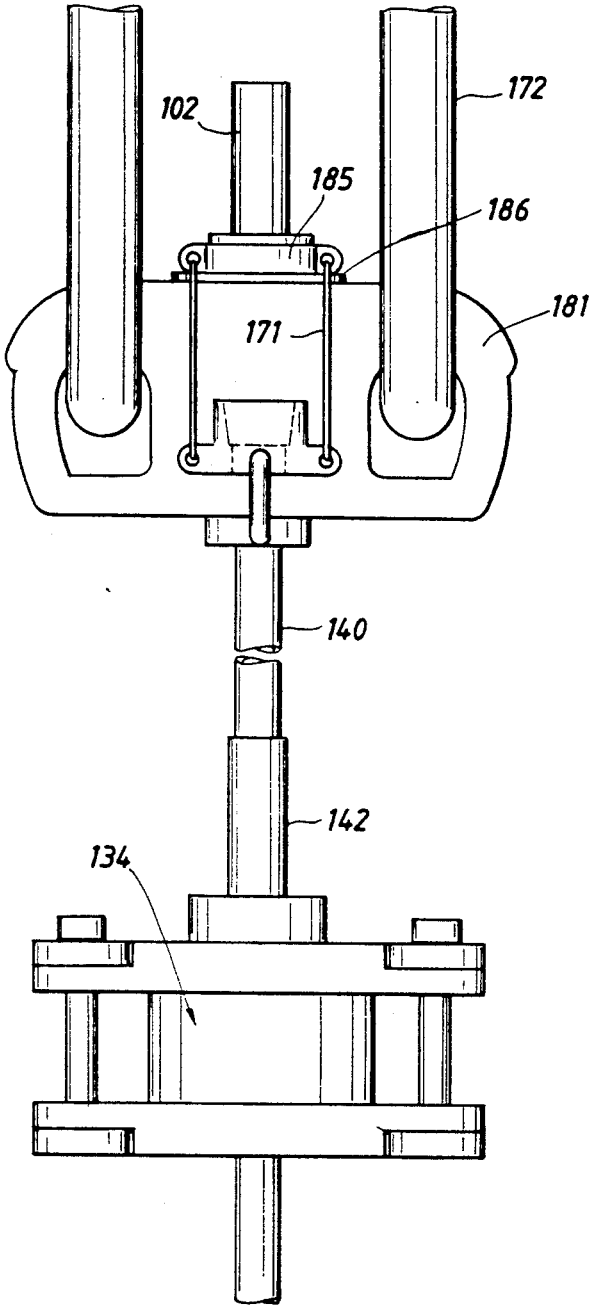
FIG.18
FIG.19
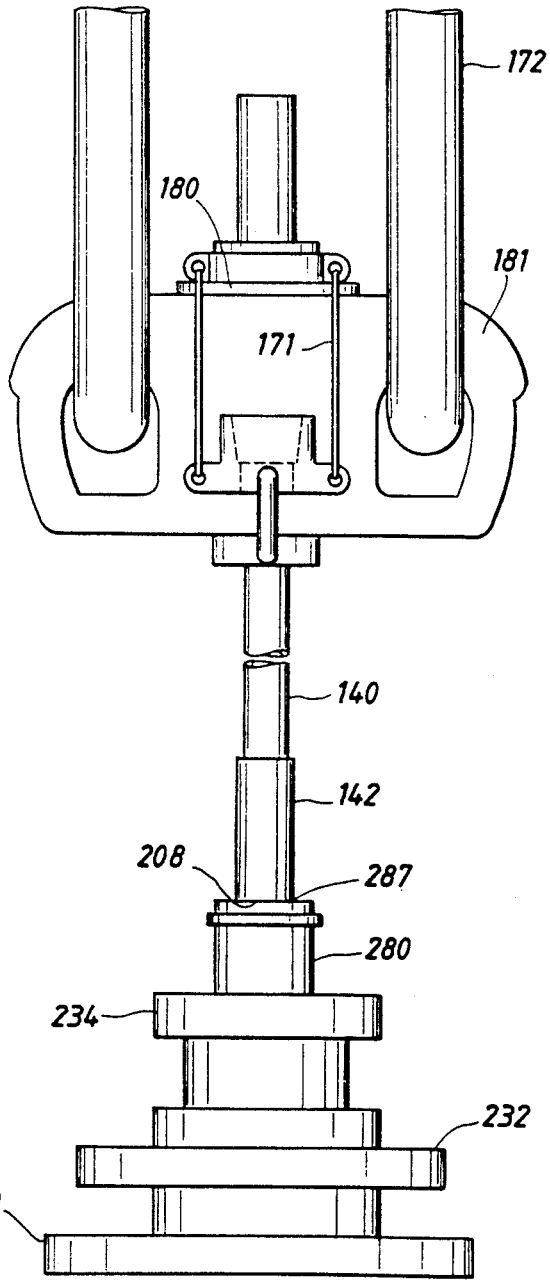

COLLAR LOAD SUPPORT TUBING RUNNING PROCEDURE

FIELD OF THE INVENTION

This invention relates to tubing running procedures for oil and gas wells, and in particular, to tubing running procedures to prevent die marks, which procedures are especially adapted for deep, high pressure wells that require the use of expensive premium material tubing.

BACKGROUND

Hostile environments found in deep, high pressure gas wells require that extra precaution be taken to select tubing that will last for the designed productive and shut in life of the well. These considerations often result in the selection of expensive tubing material, such as a corrosion resistant alloy (CRA). Use of the alloy prevents the premature failure of the production tubing due to the severe corrosive action that might result from the use of more common carbon steels.

The rise in popularity of CRA tubing in the 1980's generated a demand for sophisticated handling equipment and running procedures to lengthen the life span of the premium tubulars and the premium connections, or collars, that join them. Given the high cost of CRA or the like material, it was recognized that substantial savings would be reaped from utilizing lighter wall tubulars and connections. Thus, the high cost of premium material provided a strong incentive to optimize the tubing wall thickness to that that was required by well conditions alone, with the appropriate safety factor.

This invention responded to the challenge to develop non-abrasive tubing running procedures. "Non-abrasive" implies in this context that the procedure does not require increasing the thickness of the walls of the tubulars or their connections to take into account abrasion, such as die marks, incurred during running. In particular, this invention responded to the challenge to develop a procedure capable of running a 25,000 foot CRA string without tong, slip, or elevator marks.

Traditional tubing running procedures utilize elevators and slips that grip the string by exerting abrasive, radially inward pressure. These slips contain inserts that penetrate the tubing wall upon the application of the radial pressure. While the penetration ensures a firm grip for the elevator or slip, the penetration has been found to extend to a depth of 0.030 inches or greater into the outer tubing wall. The depth of the penetration increases with the depth of the well and the weight of the tubing string being supported. Assuming traditional tubing running procedures, once the tubing wall is optimized for well conditions, an additional wall thickness of at least 0.030" is required to compensate for the die penetration marks resulting from traditional running techniques. This extra wall thickness can add substantially to the cost of the tubing. As an example, on a 25,800' completion, an additional 14,000 pounds of CRA material would be required. This might add an incremental cost of $200,000 to the well.

A dual elevator running technique existed in the art in conjunction with the running of "upset" tubing. By this procedure, the load of the string is borne by the sloping shoulder of the "upset" portion of the tubular when gripped by one of a pair of elevators. The surface of the "upset," however, is abraded in this technique. Further, crevice corrosion develops in an area of stress concentration where the "upset" portion joins the tubing portion of the tubular. The walls on the "upset" portion of the tubing also are significantly wider than is required by well conditions alone. The close tolerances involved in working with the narrow faces on premium connections, whose wall thickness is designed for well conditions alone, made the use of the dual elevators technique unworkable. The mechanical play and the tolerance of the elevator latch and hinge alone was too great.

The narrow face of the premium connection discussed herein is measured by the difference between the collar's outside diameter (OD) and the collar's inside diameter (ID). For premium connections designed, together with their tubulars, to a thickness no greater than that required by well conditions, this wall thickness is not expected to be greater than 20% of the collar ID. Frequently, the width of this face is less than 10% of the ID. For instance, the premium connection for a three and a half inch CRA tubular would likely have a face width of from 0.1 to 0.45 inches, depending upon the design depth of the well and the designed location of the connection within the string. It should be appreciated that the width of the face is limited not only by cost considerations but also by the necessity that the collar's wall thickness remain compatible with the tubing wall thickness in important structural characteristics. For instance, having a collar with a wall thickness significantly greater than the tubing could cause the coupling joint to lose its seal under the stress of production in harsh environments. Under tension, the uneven thicknesses of the connection and the tubing could elongate at different rates. Within the limitations imposed on the collar thickness by the tubular's thickness, therefore, there is only slight leeway to increase the width of a collar face for running procedure purposes. Upper collars in the string that bear more weight may have only very slightly larger face widths than lower collars.

The tubing running procedure of the present invention teaches the elimination of abrasion or die penetration marks that have historically been associated with the makeup of the tubular connections. The data and performance of the present procedure has been tested, and the tests demonstrate the procedure's feasibility. Cost savings can be realized by the design of the wall thickness of premium tubulars and connections using criteria based only on well environment conditions.

SUMMARY OF THE INVENTION

The present invention claims a non-abrasive method for running tubing. The method comprises suspending the tubing string by resting a downward face of the upper collar of the string upon a support shoulder. A new tubular to be added to the string is made up with a new collar to comprise a tubular unit, having a box end and a pin end. Although the tubular unit usually arrives at the derrick already made up, the new collar could be added to the new tubular at various other times during the procedure that are prior to lifting the lift unit to raise the string.

A non-abrasive lift unit is attached to the new tubular. Again, the lift unit may be attached at any time during the procedure subsequent to making up the unit and prior to lifting the lift unit to raise the string. In fact, the attaching could be substantially completed before the new collar is made up on the new tubular to form a tubular unit. The attaching is not viewed as completed, however, until the tubular unit is made up so that the tubular unit is surrounded by the cuff, if a cuff lift unit is utilized, and the face of the collar rests on or is juxtaposed to the support shoulder of the cuff.

The pin of the new tubular is stabbed into the upper collar and the pin and upper collar connection are made tight, non-abrasively. The lift unit is then lifted to raise the string.

In one embodiment, the support shoulder is incorporated into a spider. The spider may further rest upon a shock table, such as a nitrogen shock table. Also in one embodiment, the lift unit is comprised of a lift sub that threads into the collar of the tubular unit. An anti-back off device may be added over the joint of the lift sub and the new collar to prevent the sub from backing off during running. Preferably, the lift sub threaded connections would be cut with no seal shoulder.

In an alternate embodiment, the lift unit may be comprised of a cuff that surrounds the tubular unit and that includes a support shoulder for resting upon it a downward face of the new collar. In this embodiment, when the lift unit is lifted to raise the string, the string is supported by the resting of the downward face of the new collar upon the support shoulder provided by the cuff.

In a further embodiment of the invention, after lifting the lift unit, the string is landed by resting upon the support shoulder a downward face of a collar located below the upper collar of the string. Subsequent to this landing, the connection just made tight may be tested.

In one embodiment of the invention, the tubular is made tight by first making the coupling hand tight and subsequently by making the coupling tight to predetermined specifications using tongs that non-abrasively attach to the outer surfaces of the upper collar and the new tubular. Also in one embodiment of the invention, the threads of the collars, or connections, and the threads of the pin end of the tubular are cut such that the radial sides of the threads slant toward the axial and radial center of the collar, or what would be the axial and radial center of the collar if the pin were made up with the collar.

In one embodiment of the invention, the tubing string is suspended by supporting a cuff on a load bearing surface and by resting the downward face of the upper collar on a support shoulder of the cuff. When two cuffs are used, one for suspending the tubing string and one as a lift unit, the cuffs may be interchangeable. In this method, the cuff that serves as a lift unit for adding a new tubular can serve next to suspend the string while the next tubular is added. The cuff that had served as the support shoulder can serve as the next lift unit.

Having described a method for adding tubulars to a string, it is clear that similar or analogous steps of the method may be used for pulling the string. Namely, a lift unit is non-abrasively attached to the upper collar of the string. The lift unit is raised and the string is suspended by resting a downward face of a lower collar of the string upon a support shoulder. The joint of a collar and the upper tubular is then non-abrasively unmade.

BRIEF DESCRIPTION OF THE DRAWINGS

FIG. 1 is a drawing of a tubular made up with collar.

FIG. 1A is an enlarged view of the mating of the tubular with the collar that illustrates the inward slant in the radial direction of the threads.

FIG. 2 illustrates a lift sub that forms a non-abrasive lift unit.

FIG. 3 shows the tubular with collar made up with the lift sub and anti-back off device.

FIG. 4 shows the string resting upon the downward face of the upper collar that is supported by a support shoulder in a spider which in turn is resting upon a nitrogen shock table that sits upon the rotary table.

FIG. 5 illustrates stabbing the pin of a new tubular into the upper collar.

FIG. 6 illustrates making tight the connection between the tubular pin and the upper collar by means of non-abrasive power tongs.

FIG. 7 illustrates lifting the string by means of an elevator attached to the lift sub.

FIG. 13 illustrates a tubular made up with collar and non-abrasive cuff.

FIG. 14 illustrates a lift sub in perspective.

FIG. 15 illustrates stabbing the tubing.

FIG. 18 illustrates lifting the string with a cuff as the lift unit and with another cuff providing the support shoulder for suspending the string.

FIG. 19 illustrates the use of two cuffs to run the tubing.

DETAILED DESCRIPTION OF THE PREFERRED EMBODIMENT

Figure 8:
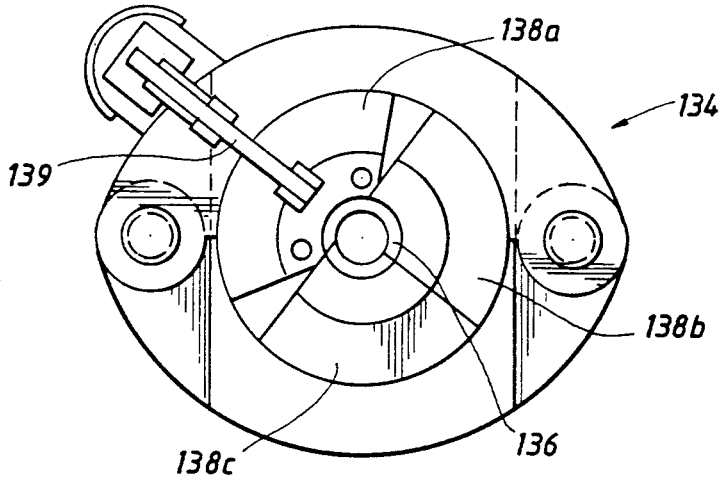
FIG. 8 is a top view of a closed spider that provides a suitable support shoulder.
Figure 9:
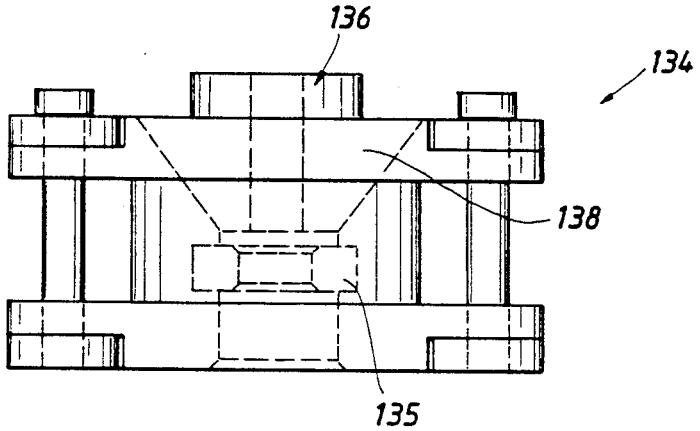
FIG. 9 is a side view of a closed spider that provides a suitable support shoulder.

Preferred embodiments for the collar load support non-abrasive tubing running procedure involve first moving racks containing new tubulars, preferably already made up with their collars into tubular units, to the catwalk. It is to be understood that the new collar can be made up on the new tubular into a tubular unit at any time prior to attaching, or completing the attaching, as described above, of the lift unit to the tubular unit.

Preferably, new tubulars contain thread protectors in the box and pin ends. It is preferred procedure at this time for the thread protectors to be removed, the threads inspected and cleaned if necessary, and the thread protectors reinstalled. The rack of tubulars is then rolled onto the pickup machine at the catwalk and moved from the catwalk to the derrick. Advisedly, only a rubber padded pickup and lay down machine is used for the tubing. At this point, again, the thread protectors may be removed from the coupling and inspected.

FIG. 1 illustrates a tubular 100 already made up with collar 102 into a tubular unit 101 (no thread thread protectors shown). Side 108 (not necessarily drawn to scale) illustrates the narrow downward face of the collar to be utilized by the invention to suspend the string. FIG. 1A illustrates the cut of the collar's and tubular's threads in one embodiment of the invention. Radial sides 103 and 105 of the threads of tubing 100 and collar 102, respectively, slant upward and to the right, which is toward the radial and axial center of the collar 102.

FIGS. 2 and 14 illustrates a non-abrasive lift unit of one preferred embodiment. FIG. 14 is drawing closer to scale. This lift unit is comprised of a steel lift sub 110.

The lift sub includes a threaded pin end 114 that will engage the threads 116 of the box end, or new collar, on the new tubular 100. In this preferred embodiment, the lift sub is made up hand tight onto the tubular unit. The connections on the lift sub are preferably cut with no seal surface to prevent damage to the tubing connection. It should be understood that the lift sub could be made up onto the tubular unit at any time prior to the lifting of the lift sub to raise the string.

Figure 10:
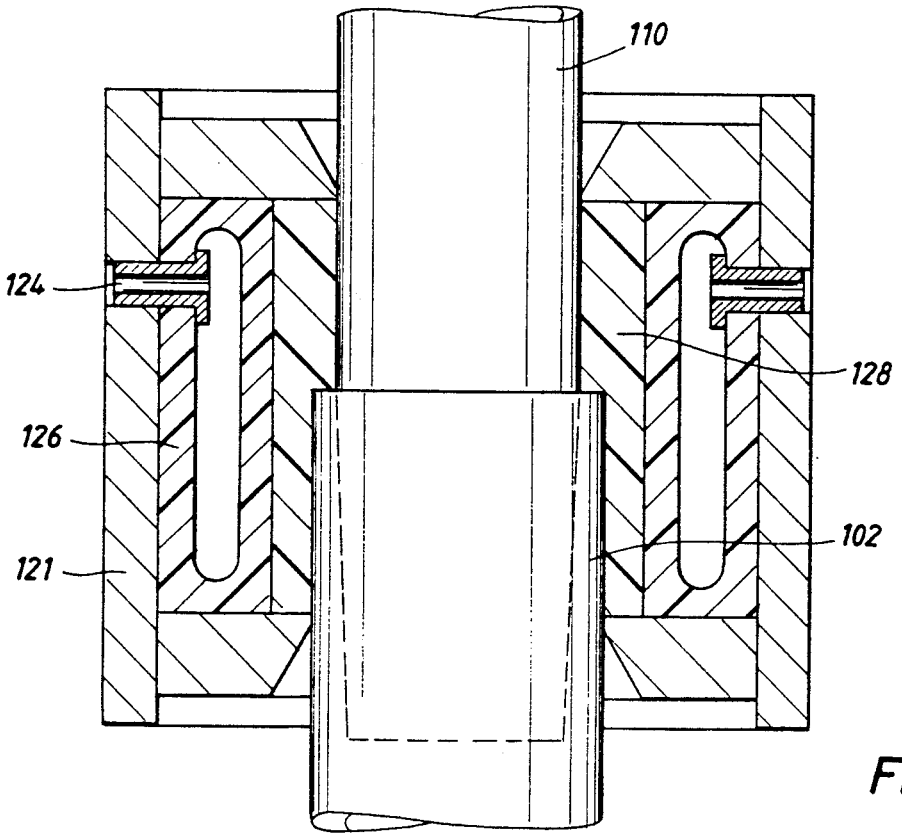
FIG. 10 is a cutaway view of an anti-back off device.

An anti-back off device 120, illustrated in FIGS. 3 and 10, is made up over the connection between the lift sub and the tubular collar. The function of the anti-back off device is to prevent the unintentional separation of the lift sub from the collar during the running of the string. FIG. 10 illustrates an embodiment of the anti-back off device 120 of a preferred embodiment in greater detail. Housing body 121 surrounds the junction of lift sub 110 with collar 102. The interior of the housing body is comprised of an elastomeric bladder 126, such as neoprene, and differential reducing bushing 128. Inlet nozzle 124 permits fluid to be injected to non-abrasively secure the anti-back off device around the coupling of new tubular 100 and new collar 102.

According to the preferred embodiment, a nylon or other non-abrasive pickup line from the block of the derrick is attached to the box end of the tubular unit. It is understood that this line will be replaced when it gets damaged. If the new tubular were not yet made up into a tubular unit, the line would be attached to the new tubular.

Thread protectors from the pin end of the tubular are removed and the threads are inspected. The threads are recleaned if required. Threads 143 of the upper collar 142, resting on spider 134, FIG. 4, are inspected.

In one preferred embodiment, spider 134 provides the support shoulder, or collar stop elevator, specially designed for this tubing running procedure. FIGS. 8, 9, 11 and 12 illustrate features of the collar stop elevator spider 134 in more detail. The spider is comprised of a collar support plate 136, slips 138 (or 138*a*, 138*b*, and 138*c*), and lower pipe guide 135. As illustrated by comparing the views of FIG. 11 and FIG. 12, collar support spider 134 is capable of moving from an opened to a closed position. In the open position, the string with collar connections may be raised and lowered through the spider. To open the spider, hinge 139 raises slip 138*a*, FIG. 8. Slip 138*a* is hingedly connected to slips 138*b* and 138*c*. They rise as slip 138*a* rises. As the slip sections rise, they move radially away from the string, thus widening the spider opening to permit passage of collars therethrough. It can be seen that in the closed position, slips 138*a*, 138*b*, and 138*c* exert pressure against each other in a plane normal to the string. They do not exert pressure against the string.

Figure 11:
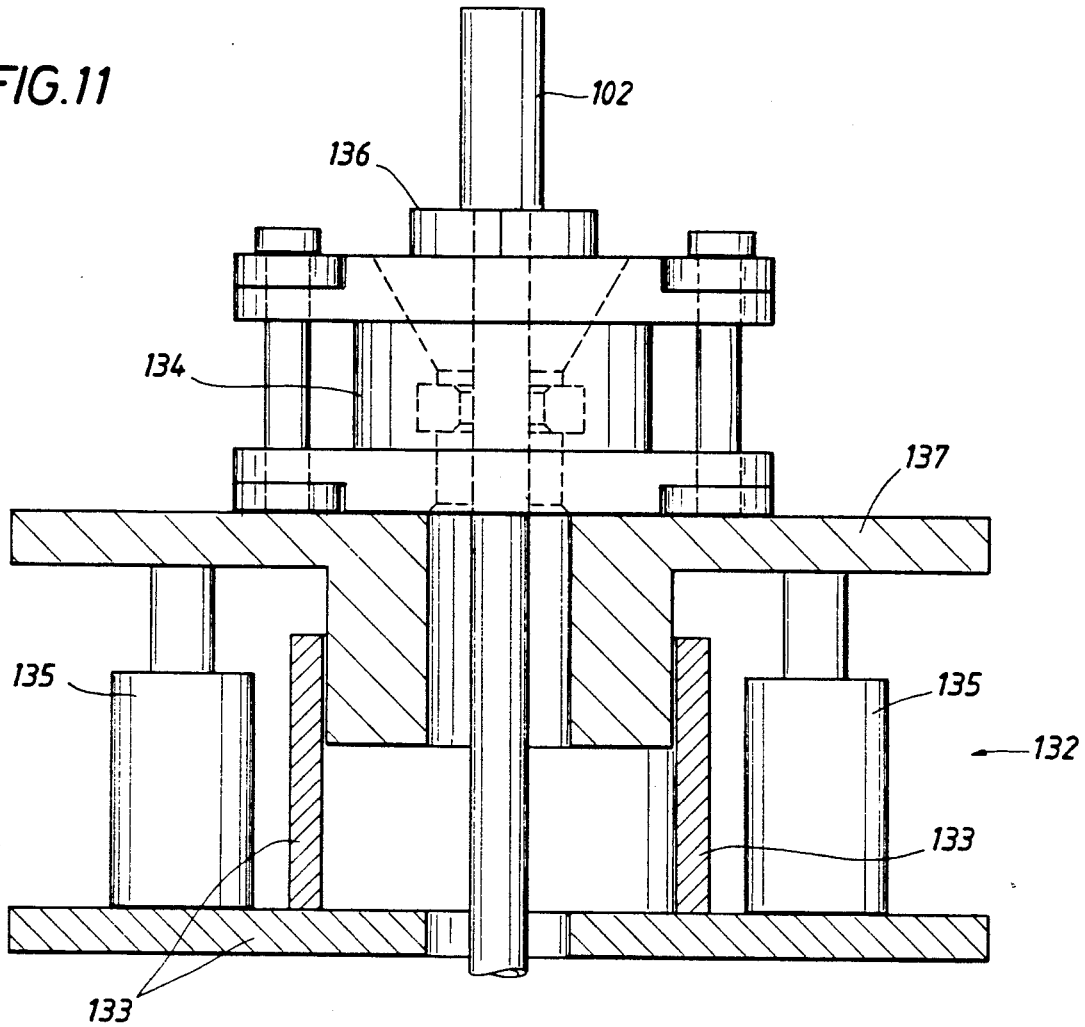
FIG. 11 is a side cutaway view of a closed spider resting on a nitrogen shock table.
Figure 12:
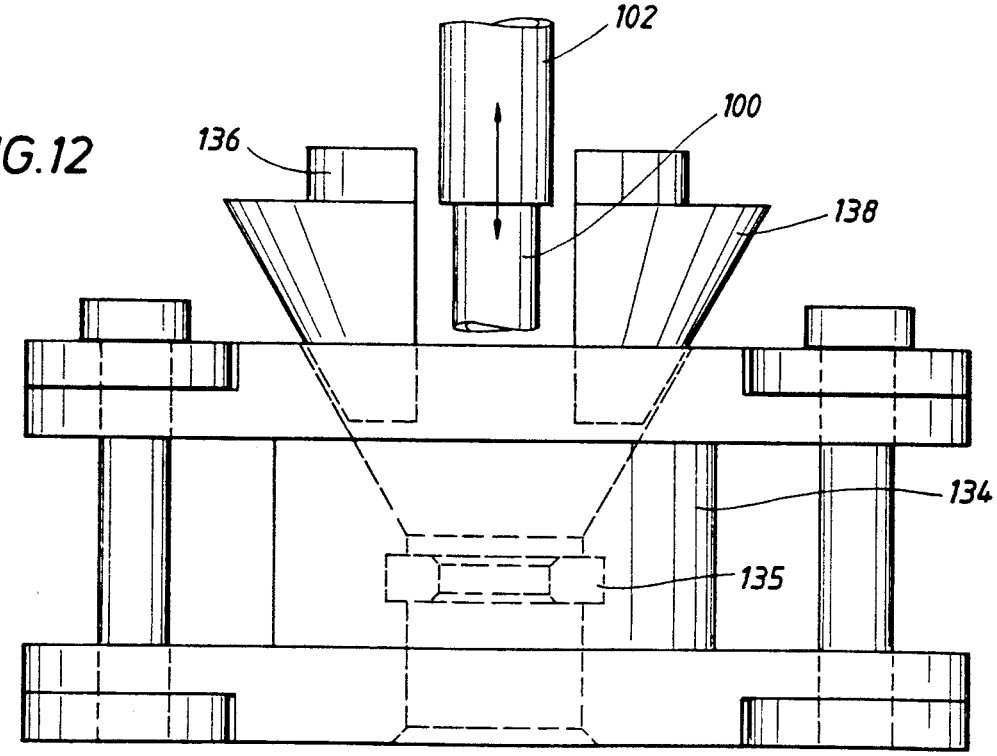
FIG. 12 is a side view of the spider opened.

In the preferred embodiment, the spider is designed to ride upon a shock table, such a nitrogen table known in the industry. FIG. 4 illustrates spider 134 resting upon nitrogen shock table 132, that is in turn resting upon rotary table 130. FIG. 11 illustrates in greater detail a nitrogen shock table wherein base and housing 133 support nitrogen filled cylinders 135 that permit the shock table load plate 137 to fluidly support spider 134.

FIG. 5 illustrates stabbing the pin end of tubular 100 into upper collar 142. The pin end is to be lowered slowly into the collar while the tubing is suspended by the pick up line from the blocks. A teflon, rubber, or polyurethane stabbing guide may be used. It is important to ensure that the tubing is vertical when stabbing. If the tubing is misstabbed, it should be raised again, cleaned, inspected, lubricated, and restabbed. Preferably, threads 104 of the pin end of the tubular are made up hand tight with threads 143 of upper collar 142. The threads are made up hand tight until the pin and shoulder engage. The proper tool to use is a friction wrench or a strap wrench. The joint should be stabilized in the vertical position during this make up. Torque should not be developed prior to seal contact between the pin and torque shoulder. If torque does develop, it indicates misalignment or cross-threading.

Using non-abrasive means on the tubing and collar, indicated generally by box 160 in FIG. 6, the tubing is made tight to a predetermined torque or position. Power tongs such as disclosed in U.S. patent application Ser. No. 394,949 can be utilized here. Tongs 162 are placed on the tubing with back up tongs 164 on the coupling. The tongs should be carefully positioned and care taken not to hit the tubing.

In one preferred embodiment, the joint made up will be tested. According to one technique, elevators 170, with connections 172 to the rig block, may be positioned around the lift sub and carefully latched onto the lift sub. The elevator is raised to pick up the weight of the tubing string and pull the joint just made tight to a stabbing board to test the coupling. The support shoulder or spider 134 is released and opened after it ceases to bear weight. Another coupling appears above the spider as the lift unit is raised. The support shoulder of the spider is closed around the tubing and the downward face of this coupling, or collar, is set upon the spider and landed to a predetermined weight, such as 10,000 pounds. A safety test shield is installed and the upper collar connection is tested to the test pressure. After a successful test, the tubing weight is again picked up with the elevator by raising the lift sub and the support shoulder of the spider is again released and opened. The tubing is lowered two lengths. The support shoulder of the spider is closed and the new upper tubing collar is set on the spider. As mentioned above, the spider preferably rests upon a nitrogen soft set shock table. The nitrogen pressure is adjusted as the string weight increases.

The lift sub is now removed and the above procedure is repeated for all joints. As is understood in the industry, similar steps as those used in the procedure to add tubing are utilized to pull the tubing. The appropriate joints are unmade rather than made, and tubulars are removed from the string.

According to another embodiment of the invention, at least one cuff is used during the tubing running procedure. Such a cuff or sleeve, as illustrated in FIG. 15, may be used as the lift unit. Sleeve cuff 180 is comprised of two halves, 180*a* and 180*b*, hinged at joint 182 and latched together when closed at joint 183. The cuff includes a flange 185 with means 184 for joining the flange to lifting apparatus associated with the derrick. The cuff also includes collar load support shoulder 187. FIG. 13 shows lay down machine trough 99 in which rests tubular 100 already made up into a unit with collar 102. Cuff 180 is secured around tubular 100 such that downward face 108 of collar 102 is juxtaposed to, or rests upon, upward support shoulder 187 of cuff 180. By means of lifting apparatus 171, 173, and 175 associated with the derrick, and joining means 184, the tubular unit may be lifted by lifting the cuff.

Figure 16:
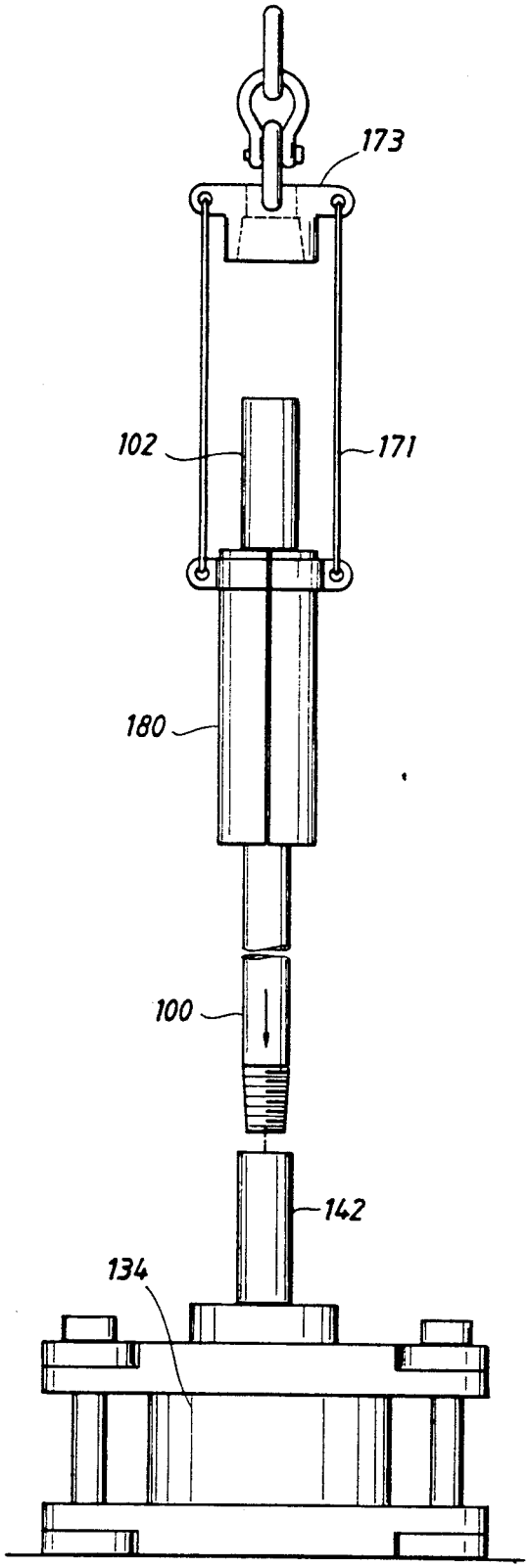
FIG. 16 illustrates a configuration of a cuff as a lift unit for the purposes of testing the connection made tight.

FIG. 16 illustrates stabbing the pin end of new tubular 100 into the upper collar 142 resting, as above, upon spider 134, with the cuff 180 attached as the lift unit.

Figure 17:
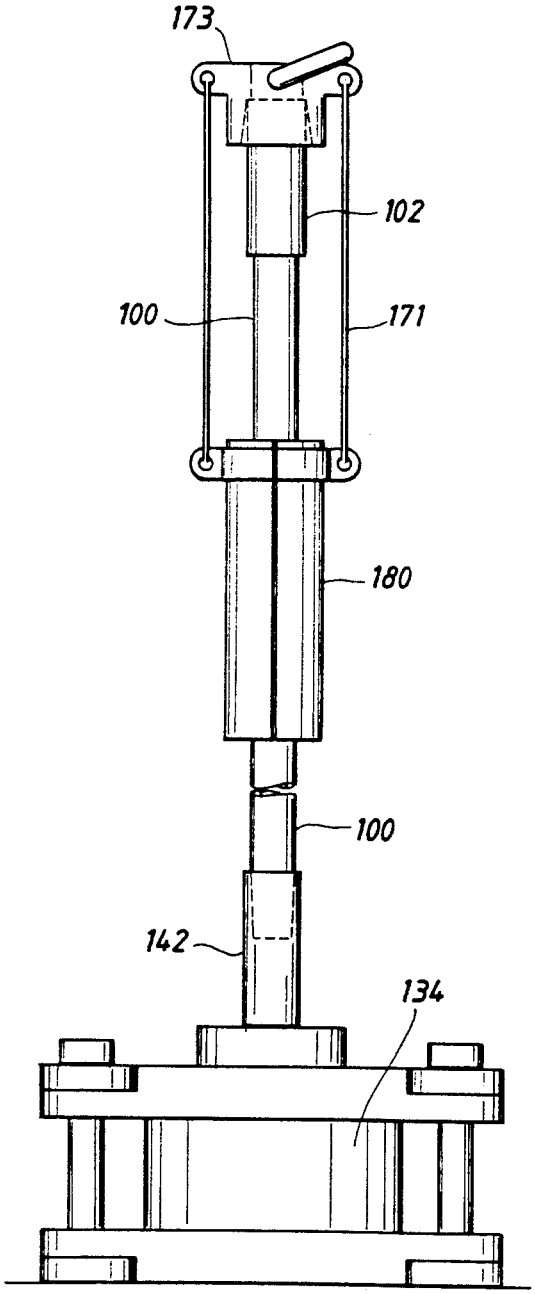
FIG. 17 illustrates lifting the string with a cuff as the lift unit.

FIG. 17 illustrates how, after the connection between new tubular 100 and upper collar 142 is made tight, cuff 180 can be lowered to facilitate a testing of the joint just made tight, if desired.

Subsequent to testing, if such testing is performed, elevator 181 associated with the derrick is latched around cuff 180, FIG. 16, such that flange 185 of cuff 180 rests upon shoulder 186 of elevator 181. The elevator may now raise the string by lifting cuff 180.

FIG. 19 illustrates an alternate embodiment of the present invention in which a second cuff is utilized as the support shoulder. In lieu of spider 134, second cuff 280 is illustrated supported by a load bearing surface of unit 234. Second cuff shoulder 287 supports upper collar 142 by the resting of lower face 208 of upper collar 142 on support shoulder 287 of cuff 280. Cuff 280 in turn rests upon a load bearing surface provided by element 234. Element 234 may rest upon shock table 232 that again may rest upon rotary table 130. In accordance with this embodiment of the invention, the cuff that formed the lift unit for the previous new tubular provides the support shoulder for suspending the string while the next tubular is added.

Having described the invention above, various modifications of the techniques, procedures, materials, and equipment will be apparent to those in the art. It is intended that all such variations within the scope and spirit of the appended claims be embraced thereby.

What is claimed is:

1. A non-abrasive method for running tubing that comprises:

(a) suspending a tubing string by resting a downward face of an upper collar of the string upon a shoulder support;

(b) making up a tubular with a collar to comprise a tubular unit;

(c) attaching a non-abrasive lift unit to the tubular unit;

(d) stabbing a pin end of the tubular unit into the upper collar;

(e) non-abrasively making the pin end and upper collar connection tight; and (f) lifting the lift unit to raise the string.

2. The method of claim 1, wherein the support shoulder is incorporated into a spider.

3. The method of claim 2 that further comprises installing the spider on a shock table.

4. The method of claim 1, wherein the lift unit is comprised of a lift sub that threadedly attaches hand-tight to a collar.

5. The method of claim 4 that further comprises attaching an anti-back off device over the joint of the lift sub and the collar.

6. The method of claim 4, wherein the lift sub threaded connections are cut with no seal shoulder.

7. The method of claim 1, wherein the lift unit is comprised of a cuff that surrounds the tubular unit and that includes a support shoulder for resting a downward face of a collar.

8. The method of claim 7, wherein the lifting comprises lifting the cuff such that the string is suspended by the resting of a downward face of a collar upon the support shoulder of the cuff.

9. The method of claim 1 that further comprises, after the lifting, landing the string on the support shoulder to a predetermined weight by resting upon the shoulder a downward face of a collar in the string.

10. The method of claim 1 that further comprises, subsequent to making the connection tight, testing the connection made tight.

11. The method of claim 1, wherein the tubular is made tight by first making the coupling hand tight and by subsequently making the coupling tight to specification using tongs that non-abrasively attach to the outer surfaces of the upper collar and the new tubular.

12. The method of claim 1 that further comprises cutting the threads of the collars and pins such that the radial sides of the threads slant toward the axial and radial center of the collar.

13. The method of claim 1, wherein suspending the tubing string further comprises supporting a cuff on a load bearing surface and resting a downward face of an upper collar on a support shoulder of the cuff.

14. The method of claim 1, wherein the lift unit is comprised of a first cuff that surrounds the tubular unit and that includes a support shoulder for resting a downward face of a collar, and wherein suspending the tubing string further comprises supporting a second cuff on a load bearing surface and resting the downward face of an upper collar on a support shoulder of the second cuff, the second cuff and the first cuff being interchangeable.

15. The method of claim 1, wherein the lift unit is non-abrasively attached to the tubular unit while the tubular unit rests in a tubular trough and that further comprises raising the tubular unit above the upper collar of the string prior to stabbing.

16. A non-abrasive method for running tubing that comprises:

(a) attaching a non-abrasive lift unit to an upper collar of a tubing string;

(b) lifting the lift unit to raise the string;

(c) suspending the string by resting a downward face of a lower collar of the string upon a support shoulder; and (d) non-abrasively unmaking the joint of an upper collar and the upper tubular of the string.

* * * * *

UNITED STATES PATENT AND TRADEMARK OFFICE

CERTIFICATE OF CORRECTION

PATENT NO. : 5,083,356

DATED : January 28, 1992

INVENTOR(S) : Manuel E. Gonzalez, et al

It is certified that error appears in the above-indentified patent and that said Letters Patent is hereby corrected as shown below:

Column 7, line 11, change "16" to —18—.

Signed and Sealed this

Twelfth Day of October, 1993

*Attest:*

Bruce Lehman

BRUCE LEHMAN

*Attesting Officer*

*Commissioner of Patents and Trademarks*